United States Patent [19]

Dulin et al.

[11] Patent Number: 4,993,980

[45] **Date of Patent: * Feb. 19, 1991**

[54] BUOYANT SUPPORT APPARATUS AND SYSTEM FOR USE IN EXERCISING

[76] Inventors: Thomas G. Dulin, 66 Lochatong Rd., West Trenton, N.J. 08628; Eric Bass, 10 Walton Ave.; Richard M. Babyak, 612 Shady Retreat Rd., #60, both of Doylestown, Pa. 18901

[ * ] Notice: The portion of the term of this patent subsequent to Jan. 20, 2006 has been disclaimed.

[21] Appl. No.: 317,415

[22] Filed: Mar. 1, 1989

Related U.S. Application Data

[63] Continuation of Ser. No. 118,386, Nov. 6, 1987, Pat. No. 4,840,591.

[51] Int. Cl.[5] ..... A63B 23/00

[52] U.S. Cl. ..... 441/129; 441/106

[58] Field of Search ..... 441/129, 136, 80, 88, 441/102-119, 125; 434/254; 272/71; 128/365

[56] References Cited

U.S. PATENT DOCUMENTS 960,129 5/1910 Wilkinson ..... 441/108

1,901,906 3/1933 Farmer et al. ..... 441/119

*Primary Examiner*—Joseph F. Peters, Jr.

*Assistant Examiner*—Edwin L. Swinehart

*Attorney, Agent, or Firm*—Caesar, Rivise, Bernstein, Cohen & Pokotilow, Ltd.

[57] ABSTRACT

An exercise device comprising a flotation jacket worn by an exerciser in water which enables the exerciser to float in an upright position while exercising and without contact with the bottom or sides of the enclosure holding the water. The jacket is fabricated from a fabric with pockets sewn in the fabric for insertion of segments of flotation material. The size and location of the segments result in equal buoyant forces at the front and back and at the sides of the exerciser to assure that the exerciser remains upright while floating in water. The fabric is such that the friction between the flotation jacket and the exerciser is increased when the fabric is emersed in water thereby preventing the jacket from riding up under the armpits of the exerciser. The flotation jacket can be fabricated easily and at low cost by using standard materials and production techniques without the need for expensive molding equipment. A buoyant support system for use in exercising is also disclosed which enables the exerciser wearing the flotation device and a harness to be supported by cables in a tank attached to the exercising device while the exerciser is floating and exercising in water placed in the tank.

7 Claims, 3 Drawing Sheets

BUOYANT SUPPORT APPARATUS AND SYSTEM FOR USE IN EXERCISING

CONTINUING DATA

This application is a continuation of U.S. Ser. No. 118,386, filed Nov. 6,1987, now U.S. Pat. No. 4,840,591, June 20, 1984.

FIELD OF THE INVENTION

This invention relates to an exercise apparatus and system for use in water, and more particularly, for use while floating upright in water.

BACKGROUND ART

The importance of exercise in maintaining fitness and good health is widely recognized. Exercise is important with regard to overall fitness and weight control. It helps maintain muscle tone, lubricates the joints, improves the circulation, and helps build and maintain healthy bones. Further, aerobic types of exercises, which raise the heart rate for an extended period of time, are considered vital in strengthening the heart and circulatory system. Such aerobic exercise requires constant movement of the major muscles of the body, specifically the arms and legs, for periods of time of 20 minutes or longer.

In view of the above, such exercises as swimming, bicycling, rowing, jogging, aerobic dancing, and brisk walking are in prevalent use, as aerobic exercises, because they set and maintain in motion the major muscles of the body. However, many of these exercises place considerable stress on the legs, hips, ankles, and feet of the exerciser.

The injuries to leg, hip, and foot normally suffered by athletes would prevent an athlete from engaging in exercises which stress the lower extremities and may result in severe pain and further injuries. Furthermore, persons with various diseases and illnesses, such as arthritis, rheumatism, and osteoporosis, (brittle bones) cannot engage in weight bearing exercises which, in particular, stress the lower extremities of the body including the feet, ankles, legs, knees and hips. Such exercise for these persons can often result in severe pain and injury.

Although swimming is a beneficial aerobic type of exercise which does not stress the lower extremities of the body, many persons either cannot swim or cannot swim for the extended periods of time required to obtain the benefits of aerobic exercising. For fitness of the heart, respiratory, and circulatory system, medical sports and exercising authorities recommend a minimum of aerobic exercise for 30 minute periods at least 3 to 4 times per week. In addition, exercise in water can exercise more and different muscles than are normally exercised in swimming.

Even if the exercise is not maintained for aerobic benefit, there is considerable benefit in exercising muscles to prevent atrophy and to maintain muscle tone, to prevent weakening of the bones, and to assist in the healing process in cases of injury and for the elderly and ill.

There are several existing devices for supporting humans or animals in water. U.S. Pat. No. 2,438,979 discloses a harness for bathing an animal in a bath tub. U.S. Pat. No. 2,785,055 involves a baby bath tub safety device which adapted for use in a bath tub. U.S. Pat. No. 3,835,815 provides a means for conditioning horses using a water-filled open tank with a horse and sling assembly for lifting and holding the horse in the tank while the horse swims.

A swimming pool exercise device by Eric Bass, one of the co-inventors of the present invention, in U.S. Pat. No. 4,552,540, discloses a flotation vest which is worn by an individual together with a frame. Adjustable security lines are attached between loops on the vest and anchoring loops located on the frame to further support the individual exercising in a swimming pool.

An exercise device for use in a tank containing water by Bass, U.S. Pat. No. 4,451,108 also discloses a flotation vest for use in a tank of water. Adjustable security lines are attached between loops on the vest and anchoring loops located on the tank. Thus, the exercise apparatus comprises the combination of the vest and the tank.

Although the Bass devices listed above allowed full exercise of the arms and legs without any impact or jaring on the feet, ankles, knees, legs, or hips of the exercisers (the exerciser is completely suspended in the water due to the buoyancy of the vest and the additional support of the security lines), they have several shortcomings. The vest is a single molded piece of rigid polyurethane or rigid foamed polyurethane which requires the design and use of fairly expensive molds to manufacture. Further, separate molds are required depending on the size, age, and sex of the exerciser. Also, while the individual is exercising, the vest tends to float upward, pressing against the armpits of the exerciser. Finally, the flotation vest is similar to those used as life jackets aboard airplanes and ships. These vests have greater buoyancy in the front than in the back so that one can swim with the head well supported out of the water. Thus, the tendency for a person wearing the flotation vest is to tilt, making it difficult to maintain an upright position. The security straps in the Bass patents not only help support the exerciser while floating in the tank, but in addition they maintain a verticle position for the exerciser.

Another flotation device is "The Wet Vest" by Bioenergetics of Birmingham, Alabama. This is also a full vest with arm holes for placement of the arms. More flotation material is used for the back of the device than the front which may cause a tilt off the upright position while floating. Furthermore, a belt is attached from front to back across the crotch of the exerciser to help prevent the vest from rising up relative to the body of the exerciser. The belt can be uncomfortable and could restrict motion of the exerciser.

OBJECT OF THE INVENTION

It is the general object of the instant invention to provide a buoyant support device and system for exercising which overcomes the shortcomings of existing devices.

It is another object of the instant invention to provide a buoyant device and system for exercising which tends to maintain the exerciser in an upright position while floating in water.

It is yet another object of the instant invention to provide a buoyant device and system for exercising which will maintain its position relative to the body of the exerciser while the exerciser is floating in water.

It is still yet a further object of the instant invention to provide a buoyant device for exercising which comprises segments of flotation material which can be inserted into the exercising device.

It is an additional object of the instant invention to provide a buoyant device for exercising which is simple, easy, and inexpensive to manufacture.

It is yet an additional object of the instant invention to provide a buoyant device for exercising which can be easily manufactured to accomodate the age, sex, and size of the exerciser.

It is still yet an additional object of the instant invention to provide a buoyant support system for exercising employing a tank with water, a flotation jacket with insertable flotation material, a shoulder harness, and support cables connected between the tank and the jacket and harness.

SUMMARY OF THE INVENTION

These and other objects of the instant invention are achieved by providing a buoyant device for exercising in water which comprises a fabric jacket into which pockets have been sewn for insertion of flotation material. The jacket is simple to manufacture in that a single piece of fabric may be folded and sewn to accomodate the flotation material and the additional straps and the harness as required.

Thus, certain standard blocks of flotation material may be used to accomodate exercise devices for children, adult females, and adult males of various sizes. The device is extremely simple and inexpensive to manufacture since standard materials can be used and no molds are required to manufacture the basic jacket.

The flotation material is so sized and located within the jacket that equal buoyancy is supplied to both the back and front and to each of the sides of the jacket thereby allowing the exerciser to remain upright while floating and exercising vigorously without contact between the exerciser's feet and the bottom of the pool or tank in which the water has been placed.

The material employed for the jacket is such that as it is immersed in water the friction between the inner surface of the jacket and the body of the exerciser is increased. Furthermore, adjustable belts on the jacket provide for a snug fit of the jacket to the exerciser. This prevents the flotation jacket from riding up and pressing against the armpits of the exerciser while the exerciser is floating in water.

For those requiring additional security or a controlled environment while exercising in deep water, a harness is attached to the jacket. The exerciser wearing the jacket and harness is immersed in the water of a tank. Security lines are attached between security loops on the tank and straps connected to the harness which provide additional support to the exerciser.

BRIEF DESCRIPTION OF THE DRAWINGS

Other objects and many of the intended advantages of this invention will be readily appreciated when the same becomes better understood by reference to the following detailed description when considered in connection with the accompanying drawing wherein.

DESCRIPTION OF THE PREFERRED EMBODIMENT OF THE INVENTION

Figure 1:
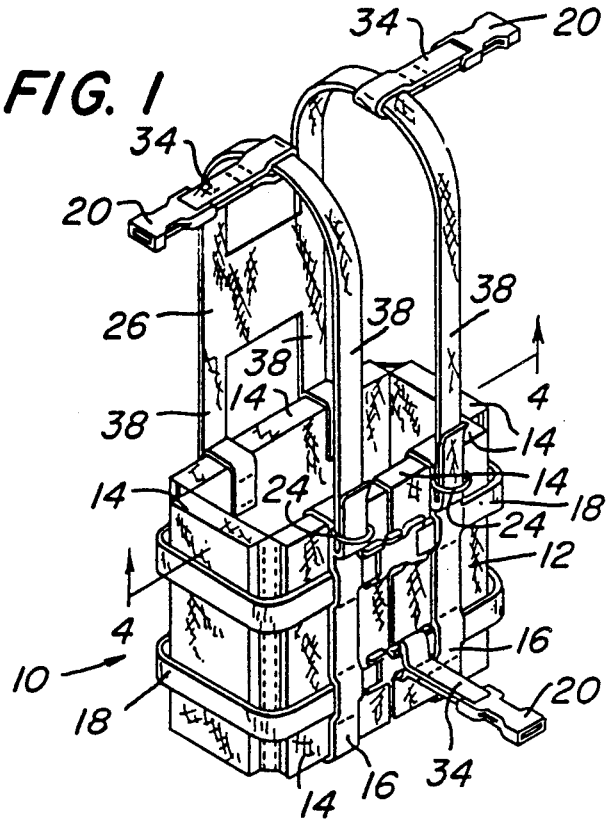
FIG. 1 is a perspective view of the exercise device showing the flotation jacket and the harness attached thereto.
Figure 5:
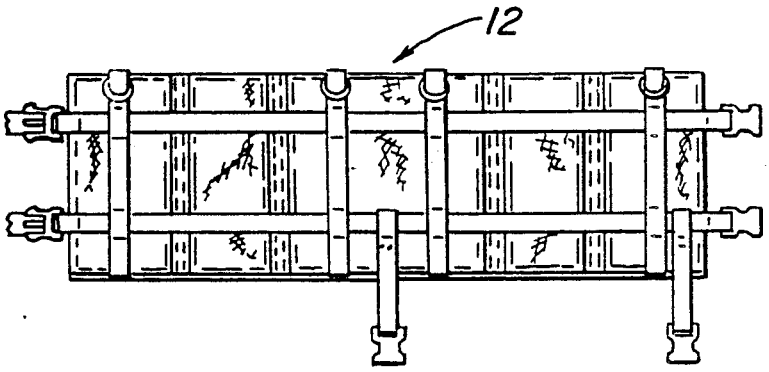
FIG. 5 shows a plan view of an extended flotation jacket sized for use by a child.
Figure 6:
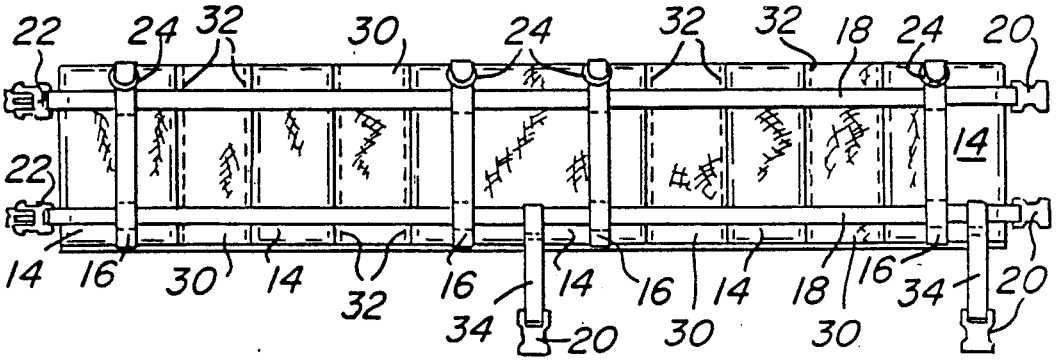
FIG. 6 is a plan view of an extended flotation jacket sized for use by an adult female.
Figure 7:
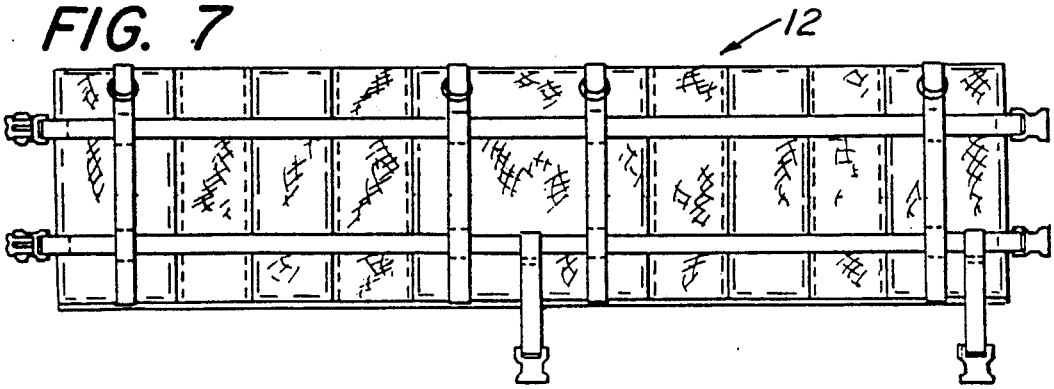
FIG. 7 is a plan view of an extended flotation jacket sized for use by an adult male.

Referring now in greater detail the various FIGS. of the drawing wherein like reference characters refer to like parts, there is shown in FIG. 1 the buoyant device 10 of the present invention. Buoyant device 10 comprises fabric flotation jacket 12 which has pockets sewn therein into which segments of flotation material 14 have been inserted. As can be seen in FIGS. 5, 6, and 7, which are plan views of extended flotation jackets sized for children, adult females, and adult males exercisers, respectively, five such segments of flotation material 14 have been inserted in the flotation jackets. One wide segment is placed at the back of the jacket. There are also two side segments and two end segments which are positioned at the sides and the front of the exerciser when the jacket is worn.

Figure 3:
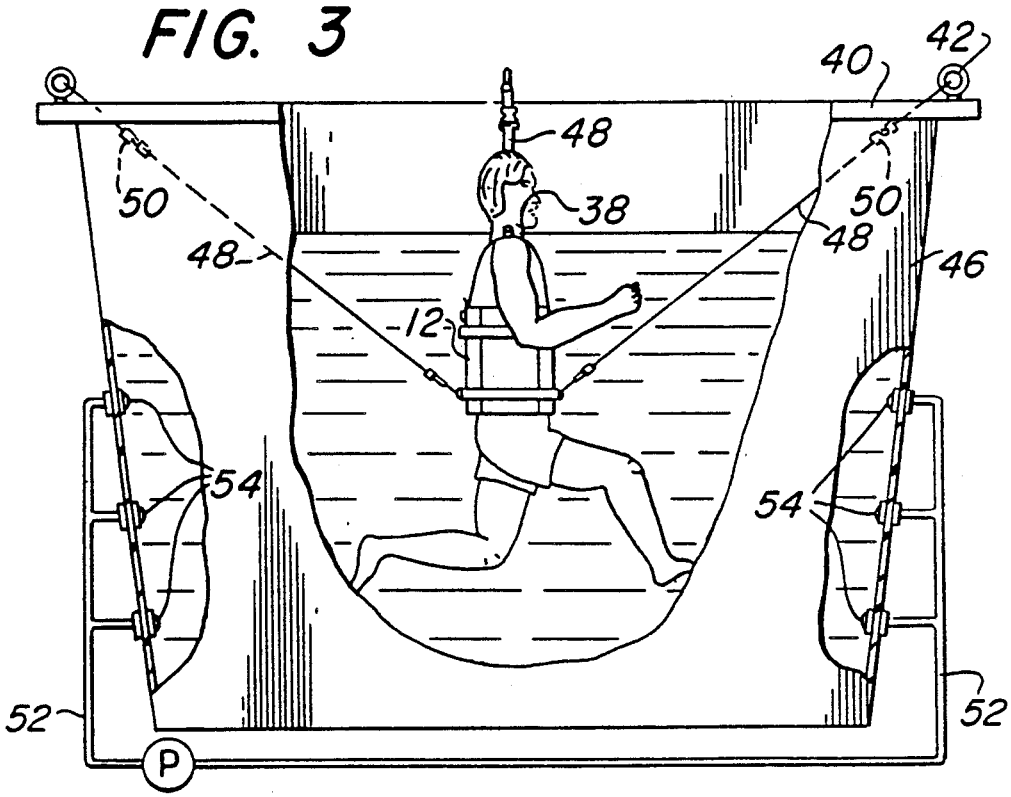
FIG. 3 is a side elevation cut-out view of an exerciser wearing the exercise device in the tank with water with supporting cables attached between the tank and the flotation jacket and harness.

Referring to FIGS. 1 and 5–7 vertical strips 16 have been sewn into the fabric of flotation jacket 12. Note that a full set of reference characters in the description which follows has been placed on FIG. 6 only since the flotation jackets 12 of FIGS. 5, 6, and 7 are identical except for size. The seams are such that openings remain through which belts 18 may be placed between the jacket and the straps. Buckle receptors 20 and buckle inserters 22 are attached to the ends of belts 18. The loose end of each belt 18 is threaded through buckle inserter 22 making belts 18 adjustable so that the belts 18 may be lengthened or shortened between inserter 22 and receptor 20 to fit flotation jacket 12 tightly about the exerciser when worn. As shown in FIG. 3, the flotation jacket 12 is worn around the lower torso when exercising.

Clamping rings 24 are attached to the vertical strips 16 and positioned so that there are 2 pairs at the back of the exerciser and 2 pairs at the front of the exerciser when the flotation jacket 12 is worn. The purpose of the rings is to releasably attach harness 26 to jacket 12 (FIG. 1). Harness 26 is used to allow for attachment of security cables when the flotation device is used in connection with a tank filled with water as will be explaned in detail later.

Figure 4:
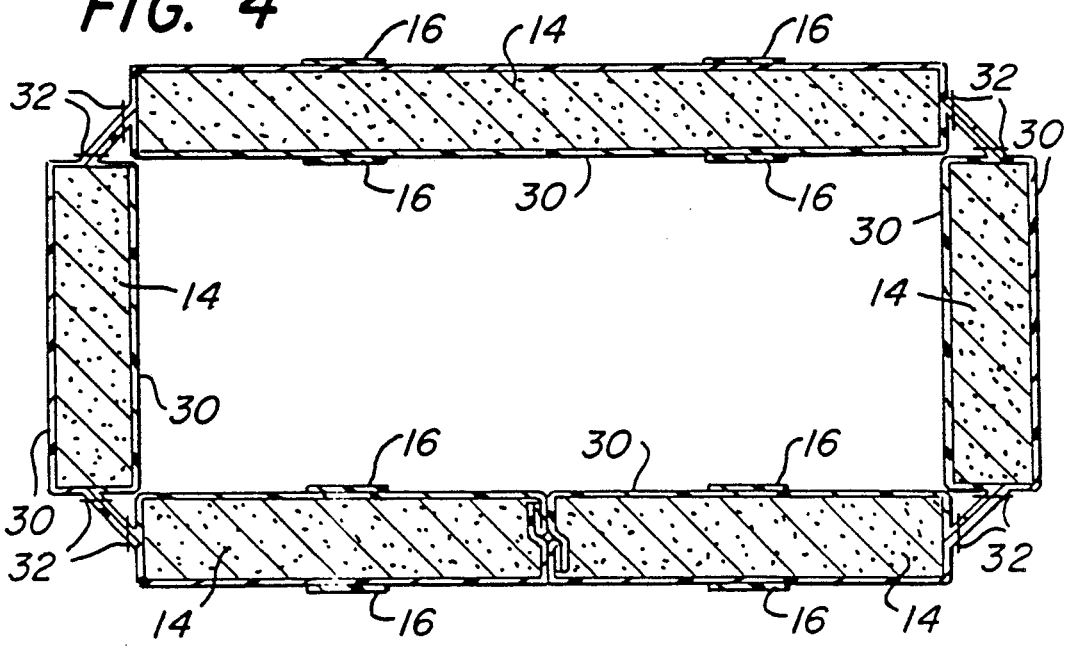
FIG. 4 is an enlarged sectional view of the flotation jacket taken along the line 4—4 of FIG. 1.

The fabrication of flotation jacket 12 may be explained by referring to FIG. 4 which is a sectional view of the flotation jacket 12 taken along the line 4—4 of FIG. 1. Fabric material 30 is initially a single section of material. Vertical strips 16 are then sewn onto the material 30. The fabric is then folded in half and pockets are formed by sewing the fabric material 30 along seams 32 and the ends of the material 30 are then sewn shut. The segments of flotation material 14 are then inserted into the pockets and the bottom of the pockets are sewn shut. Belts 18 (See FIGS. 1 and 5–7) are attached to the jacket through openings in the sewn areas of vertical strips 16.

Referring to FIG. 6 it can be seen that shortening or lengthening the belts 18 will shorten or lengthen the distance between segments 14 by folding or extending the fabric material 30 between the segments 14, thus enabling the wearing of the jacket 12 snugly by exercisers of various girths.

The flotation jacket 12 as shown in FIGS. 1 and 5–7

The flotation jacket will enable an exerciser to float upright in a pool with water while exercising the legs and arms vigorously and without touching the bottom or any sides of the pool. Thus, for individuals who are elderly or have injuries or illnesses, exercise is enabled without the necessity of weight bearing by the legs and without impact which could injure the feet, ankles, legs, knees, or hips of the exerciser.

In the preferred embodiment, a fabric material of 200 dernier nylon with a DWR (Durable Water Repellancy) water repellant coating may be used. This fabric and coating have the property of increased friction with respect to the body of the exerciser when the material is immersed in water and made wet. Thus, the exerciser is not troubled by a flotation jacket which tends to rise when the exerciser wearing the jacket is immersed in water, and to press up against the armpits of the exerciser.

Other flotation vests use a smooth material or a vinyl dipped material which tend to rise up against the body of the exerciser when in use.

The segments of flotation material are preferably a foam made of ensolite which is closed cell PVC-NVR Nitrile Rubber Compound. The material used for the strips 16 and belts 18 may be made of polyethylene synthetic woven material, and the buckle receptors and inserters may be an acetal impregnated molded nylon.

The dimensions of the flotation jackets 12 and segments of flotation material 14 for children, adult females, and adult males will now be given with reference to FIGS. 5–7. As stated previously, FIG. 5 shows an extended flotation jacket 12 sized for a child. The length of all segments of flotation material 14 is about 8 inches. The width of the center segment 14 is 8 inches, the widths of the adjacent pair of side segments 14 are 3 inches, and the widths of the end segments 14 are 4 inches. The overall extended width of the flotation jacket 12 as shown is FIG. 5 is approximately 26 inches. By varying the length of the belts 18 between the buckle receptors 20 and buckle inserters 22 as explained previously, the jacket 12 may be worn by children with girths of 22 to 26 inches.

Referring now to FIG. 6 which shows a plan view of flotation jacket 12 sized for an adult female. The lengths of the five segments 14 are approximately 8 inches. The width of the center segment 14 is 12 inches, the widths of the two adjacent segments 14 are 4 inches and the widths of the end segments 14 are approximately 6 inches. Belts 18 may be adjusted to fit the jacket 12 on adult females with 32 to 48 inches of girth.

The flotation jacket 12 for an adult male is shown in plan view in FIG. 7. All of the segments of flotation material 14 are 10 inches in length with the width of the center segment 14 being 12 inches. The widths of the two adjacent segments are 4 inches and the widths of the two end segments 14 are 6 inches. The extended width of the flotation jacket 12 for an adult male as shown is approximately 48 inches. Adjustment of the length of belts 18 will allow jacket 12 to be worn by adult males with girths of 32 to 48 inches.

The dimensions given above are intended to be only representative and not exact. The child's flotation jacket 12, ash shown in FIG. 5, is intended for a child weighing 95 to 120 pounds. The adult female flotation jacket 14, as shown in FIG. 6, is intended for females that are approximately 135 to 195 pounds. The adult male flotation jacket 14, as shown in FIG. 7, is intended for adult males weighing from 162 to 208 pounds.

Figure 2:
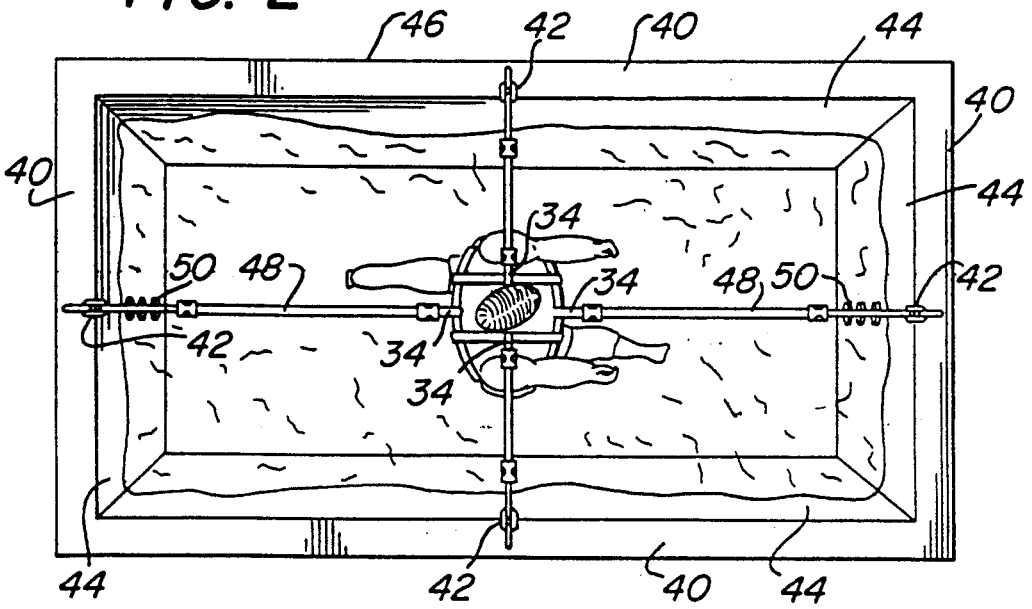
FIG. 2 is a top plan view of the buoyant support system showing an exerciser wearing the flotation jacket and the harness exercising in a tank with security cables attached between the tank and the harness and flotation jacket.

Of course, additional sizes may be added to cover children and adults of various heights, weights, and types of body build.

Where a controlled environment is required for persons who are desirous of additional security while exercising in deep water, a harness 26 is attached to flotation jacket 12, as shown in FIG. 1, by clamping harness straps 38 through clamping rings 24. In addition, security straps 34 are added. A security strap 34 is secured to each harness strap 38 and an additional security strap 34 to the lower belt 18 at both the front and back of jacket 12, as shown in FIGS. 1 and 2. Security straps 34 are terminated by buckle receptors 20.

As can be seen in FIG. 1, the height of the harness above the flotation jacket 12 is adjustable by varying the length of the free end of harness straps 38 prior to clamping the straps in clamping rings 24. Thus, the height of the harness 26 is adjustable to conform with the height of the exerciser.

The jacket and harness may then be applied to the exerciser by placing the top of the harness 26 on the shoulders of the exerciser and buckling the belts 18 around the exerciser. The arms of the exerciser naturally go through the openings in the sides of the harness.

FIGS. 2 and 3 show plan and side elevation views respectively, of an exerciser using the flotation jacket 12 and the harness 26 in a tank filled with water. Anchor rings 42 are emplaced on the top 40 of the sides 44 of tank 46. Security cables 48 are connected between anchor rings 42 and security straps 34 by buckles 20 as shown. Turnbuckles 50 are used in conjunction with the cables 48 at the front and rear of the exerciser to apply the proper tension to the cables.

As shown in FIGS. 2 and 3 the exerciser is held firmly in place by the security cables 48 while floating in tank 46. The use of tank 46 offers other advantages in addition to security. The water in the tank may be varied in temperature and purified. In addition, piping 52 feeds ten aeration jet outlets 54 to provide a whirlpool type of massage action for the exerciser. Finally, the small tank allows for individual attention and instruction to the exerciser by a physical therapist or trainer.

As with strips 16 and belts 18, straps 38 and security cables 48 may be made of polyethelene synthetic woven material.

Thus, as described in the foregoing, the device of the invention allows persons to exercise vigorously while floating in water. The exercise does not entail weight bearing by the legs of the exerciser or the shock and inpact which can result in injury and pain while exercising. The device is particularly applicable for athletes which injuries of the lower extremities including the feet, ankles, legs, knees, and hips or persons who have suffered accidents or incapacitating illnesses such as arthritis or rheumatism. The device is also of particular value to allow for individuals with osteopsorosis to exercise without fear of serious injury. It provides exercise to maintain muscle tone, improve blood flow, and increase physical and aerobic capability in a safe, non-injurious manner.

The invention also incorporates a buoyant system for use in exercising for those persons who desire the additional security of support cables and who need individualized attention and instruction while exercising. For this system, a harness is attached to the flotation jacket and the exercise takes place in a tank with anchor bolts with cables connected between the anchor bolts and the flotation jacket and harness.

Without further elaboration, the foregoing will so fully illustrate the invention that others may, by applying current or future knowledge, readily adapt the same for use under various conditions of service.

What is claimed as the invention is:

1. A buoyant support system for use by an individual for exercising in a tank with water, said system comprising a jacket to be worn closely about the trunk of the individual entirely below said individual's armpits, a harness, a means for connecting said jacket and said harness to said tank, means for attaching said harness to said jacket, said jacket comprising a plurality of segments of buoyant material, covering means for encasing said segments of buoyant material in said jacket, and for forming flexible joints interposed between said segments with the space in between said segments being adjustable, and holding means for wrapping said jacket about the trunk of said individual so that said segments completely encircle said trunk, said holding means comprising at least one adjustable belt encircling said segments and interposed joints to adjust the spacing of said segments with respect to one another when said jacket is in place, whereupon said jacket is held in place by the frictional engagement of said covering means with said trunk.

2. The support system of claim 1 wherein said jacket comprises fabric material and said covering means for encasing said buoyant material in said jacket comprises pockets sewn into said fabric material, said buoyant material being encased by sewing said pockets shut after said buoyant material has been placed therein.

3. The support system of claim 2 wherein said fabric material is such that the friction between said jacket and said trunk increases when said fabric material is wet.

4. The support system of claim 1 wherein said segments of buoyant material are sized, formed, and encased in said jacket to provide equal buoyancy at the front and at the back and at the sides of said individual when the spacing of said segments with respect to one another is adjusted when said jacket is in place.

5. The support system of claim 1 wherein said jacket comprises a front, a back, and two sides and said buoyant material comprises five segments with one segment in the back of said jacket, one segment in either side of said jacket, and two segments in the front of said jacket.

6. The support system of claim 2 wherein said fabric material of said jacket comprises two hundred dernier, textured woven nylon.

7. The support system of claim 5 wherein said buoyant material comprises eusalite foam, a closed cell PVC-NBR Nitrile Rubber Compound.

* * * * *